US005952970A

United States Patent [19]

Kawahata

[11] Patent Number: 5,952,970

[45] **Date of Patent: *Sep. 14, 1999**

[54] ANTENNA DEVICE AND COMMUNICATION APPARATUS INCORPORATING THE SAME

[75] Inventor: Kazunari Kawahata, Kyoto, Japan

[73] Assignee: Murata Manfacturing Co., Ltd., Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/654,825

[22] Filed: May 29, 1996

[30] Foreign Application Priority Data

May 31, 1995 [JP] Japan ..... 7-134060

[51] Int. Cl.[6] ..... H01Q 1/38

[52] U.S. Cl. ..... 343/700 MS; 343/873; 333/246

[58] Field of Search ..... 343/700 MS, 846, 343/702, 873, 848, 850; 333/116, 246

[56] References Cited

U.S. PATENT DOCUMENTS

| | | | |
|---|---|---|---|
| 4,131,893 | 12/1978 | Munson et al. . | |
| 4,218,682 | 8/1980 | Frosch . | |
| 4,486,758 | 12/1984 | de Ronde | 343/700 MS |
| 4,800,392 | 1/1989 | Garay et al. . | |
| 4,903,033 | 2/1990 | Tsao et al. | 343/700 MS |
| 4,929,959 | 5/1990 | Sorbello et al. | 343/700 MS |
| 4,973,972 | 11/1990 | Huang | 343/700 MS |
| 5,241,321 | 8/1993 | Tsao | 343/700 MS |
| 5,262,791 | 11/1993 | Tsuda et al. | 343/700 MS |
| 5,369,379 | 11/1994 | Fujiki | 333/116 |
| 5,442,367 | 8/1995 | Natio et al. | 343/700 MS |
| 5,448,209 | 9/1995 | Hirai et al. | 333/204 |
| 5,448,250 | 9/1995 | Day | 343/700 MS |
| 5,594,455 | 1/1997 | Hori et al. | 343/700 MS |
| 5,608,364 | 3/1997 | Hirai et al. | 333/204 |
| 5,654,681 | 8/1997 | Ishizaki et al. | 333/204 |

FOREIGN PATENT DOCUMENTS

| | | |
|---|---|---|
| 0707354A1 | 9/1995 | European Pat. Off. . |
| 60-048626 | 3/1985 | Japan . |
| 60-134605 | 7/1985 | Japan . |

*Primary Examiner*—Don Wong
*Assistant Examiner*—Tho Phan
*Attorney, Agent, or Firm*—Ostrolenk, Faber, Gerb & Soffen, LLP

[57] ABSTRACT

An antenna device has a dielectric block; a radiating electrode disposed in said dielectric block; and a coupler electrode disposed in said dielectric block so as to be electromagnetically coupled to said radiating electrode. The antenna device has a reduced size despite the use of a dielectric material having a comparatively small dielectric constant, by virtue of the fact that the radiating electrode and the coupler electrode are arranged inside the dielectric block.

8 Claims, 7 Drawing Sheets

FIG. 5
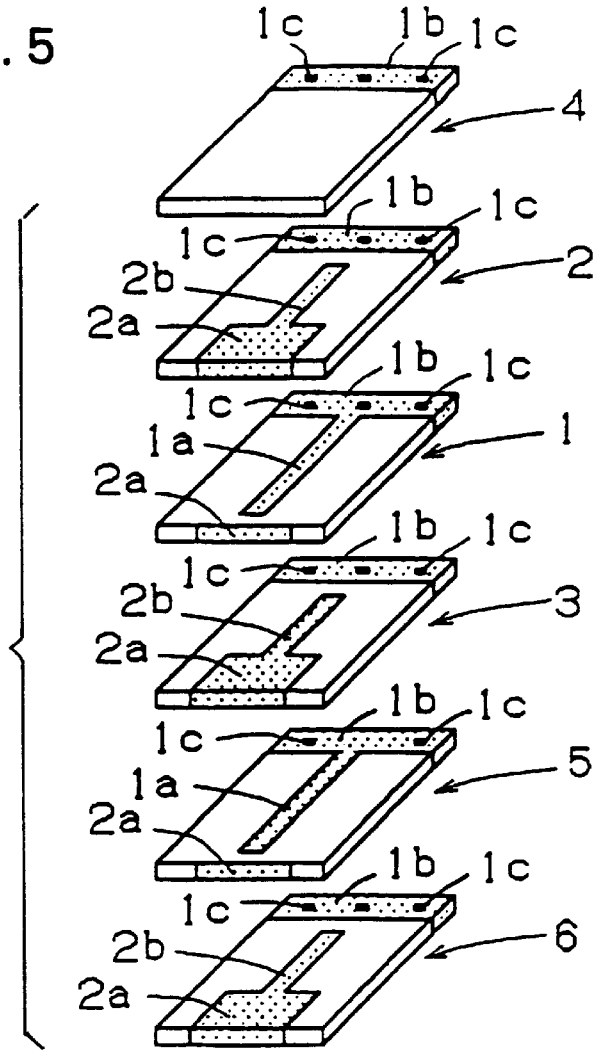
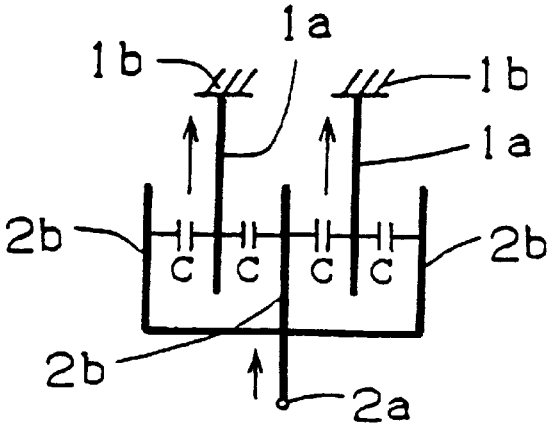
FIG. 6

FIG. 11
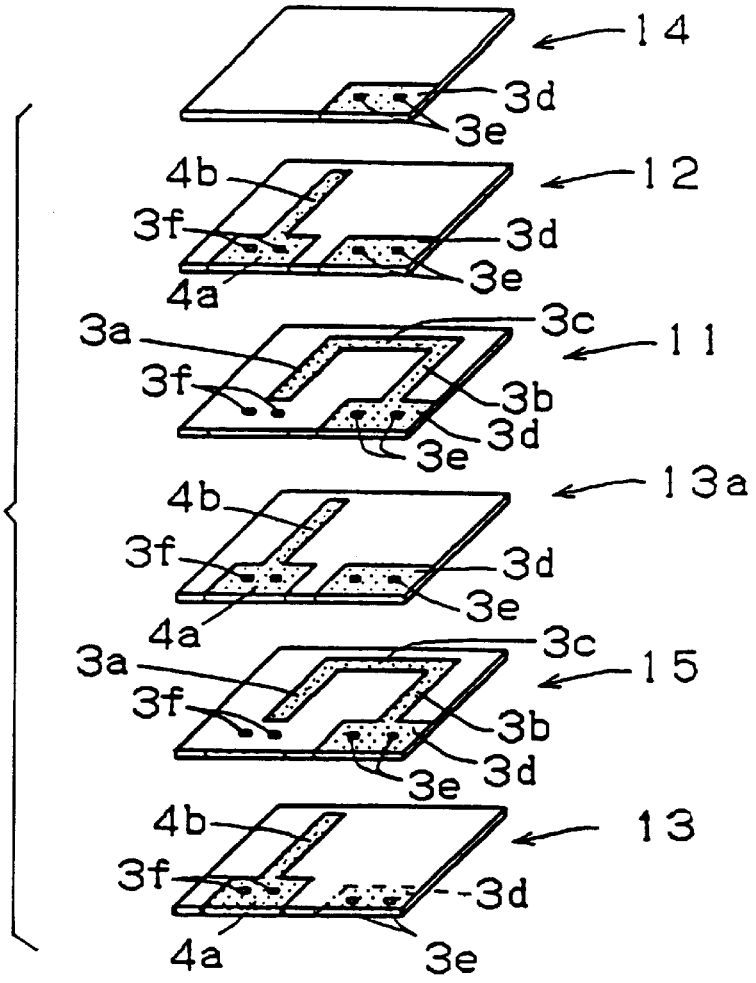
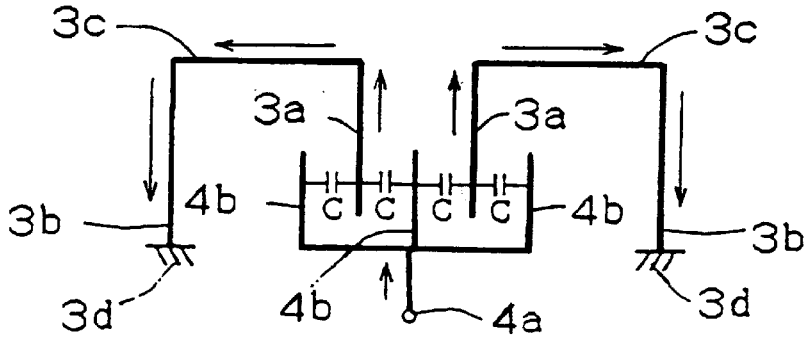
FIG. 12

ANTENNA DEVICE AND COMMUNICATION APPARATUS INCORPORATING THE SAME

BACKGROUND OF THE INVENTION

1. Field of the Invention

The present invention relates to an antenna device and, more particularly, to a surface-mount type antenna device suitable for use in, for example, a mobile communication system or a wireless LAN (Local Area Network) system.

2. Description of the Related Art

Referring to FIG. 14, a conventional surface-mount type antenna has a rectangular dielectric substrate member 31 made of ceramics or a resin and having a through bore 32. The wall surface defining the through bore 32 has a radiating electrode 32*a* formed therein. A capacitance loading electrode 35 formed on one side surface of the dielectric substrate member 31 is connected to the radiating electrode 32*a*. A feeder electrode 33 is provided on the side surface of the dielectric substrate member opposite to the capacitance loading electrode 35 and is connected to the radiating electrode 32*a*. Ground electrodes 34*a* and 34*b* are disposed at both sides of the feeder electrode 33. In use, this surface-mount type antenna is mounted on a printed circuit board, with the feeder electrode 33 connected to the input end of an RF circuit.

In order to miniaturize the conventional surface-mount type antenna, it is necessary to increase the dielectric constant of the dielectric substrate member 31 so as to enhance the capacitances between the capacitance loading electrode 35 and the ground electrodes 34*a*, 34*b*. An increase in the dielectric constant of the dielectric substrate member 31 causes an increase of the Q factor, with the result that the frequency band of the antenna is undesirably narrowed.

Considering that the frequency response of a communication apparatus may be shifted due to the influence of a housing, a nearby object, or the like, it is not preferred that the frequency band of the antenna is narrowed.

SUMMARY OF THE INVENTION

Accordingly, an object of the present invention is to provide a surface-mount type antenna device which, despite the use of a dielectric member having a comparatively low dielectric constant, can have a size small enough to enable mounting on a printed circuit board while exhibiting a wide frequency band.

A further object is to provide a communication apparatus incorporating such an antenna device.

To this end, according to one aspect of the present invention, there is provided an antenna device, comprising: a dielectric block; a radiating electrode disposed in the dielectric block; and a coupler electrode disposed in the dielectric block so as to be electromagnetically coupled to the radiating electrode.

The arrangement may be such that the radiating electrode and the coupler electrode are planar and the coupler electrode has a major surface substantially parallel to a major surface of he radiating electrode.

Each of the radiating electrode and the coupler electrode may be extended to the exterior of the dielectric block so as to be accessible from the exterior.

According to another aspect of the present invention, there is provided a communication apparatus, comprising: a transmission/receiving control unit; a transmitter circuit connected to the transmission/receiving control unit; a receiving circuit connected to the transmission/receiving control unit; a power supply unit; and an antenna device; wherein the antenna device comprises: a dielectric block; a radiating electrode disposed in the dielectric block; and a coupler electrode disposed in the dielectric block so as to be electromagnetically coupled to the radiating electrode and connected to the power supply unit.

According to still another aspect of the present invention, there is provided an antenna device, comprising: a dielectric block; radiating electrode strips disposed in the dielectric block; and feeder electrode strips disposed in the dielectric block so as to be electromagnetically coupled to the radiating electrode strips; the radiating electrode strips and the coupler electrode strips being laminated alternately such that at least one of the radiating electrode strips is interposed between the coupler electrode strips.

The plurality of radiating electrode strips may include at least a pair of radiating electrode strips having different areas.

In this antenna device, the radiating electrode and the coupler electrode may be extended to the exterior of the dielectric block so as to be accessible from the exterior.

The radiating electrode may include: a first portion disposed in the vicinity of the coupler electrode so as to form an electromagnetic coupling with the coupler electrode; and a second portion disposed in the vicinity of the outer surface of the dielectric block and forming a substantially smaller electromagnetic coupling with the coupler electrode than the first portion.

The first and second portions may be connected to each other through a bridging strip.

According to a further aspect of the present invention, there is provided a method of producing an antenna device, comprising the steps of: preparing a first dielectric ceramics green sheet; forming a radiating electrode pattern on the first dielectric ceramics green sheet by applying a radiating electrode forming material thereon; preparing a second dielectric ceramics green sheet; forming a coupler electrode pattern on the second dielectric ceramics green sheet by applying a coupler electrode forming material at a position where the coupler electrode pattern forms an electromagnetic coupling with the radiating electrode pattern when the first dielectric ceramics green sheet is superposed on the second dielectric ceramics green sheet; forming a laminated structure by alternately laminating at least one first dielectric ceramics green sheet and at least one second dielectric ceramics green sheet; applying, to an outer surface of the laminated structure, a first external electrode material in electrical connection to the radiating electrode; applying, to an outer surface of the laminated structure, a second external electrode material in electrical connection to the coupler electrode; and firing the laminated structure.

In the antenna device in accordance with the present invention, a radiating electrode having one end connected to a ground electrode and a feeder electrode are laminated in a dielectric member and are coupled to each other through a coupling capacitance. The coupling capacitance is varied by changing the factors such as the length of the electrode, width of the electrode and the thickness of the dielectric green sheet, thus enabling control of radiation resistance and resonance frequency. It is possible to use a dielectric member of a low dielectric constant by adjusting the coupling capacitance and using a U-shaped radiation resistor. This enables the frequency band to be expanded and the size of the antenna device to be reduced.

The radiating electrode can have two discrete portions: a portion which is mainly used for coupling to a coupler electrode and a portion which is mainly used for determination of frequency of the electromagnetic wave. This permits the resonance frequency matching and the input impedance matching of an antenna to be achieved independently in designing an antenna device.

The surface-mount type antenna device of the present invention, when mounted on a communication apparatus, eliminates the necessity for a connecting cable between the antenna terminal and the RF input terminal.

These and other objects, features and the advantages of the present invention will become clear from the following description when the same is read in conjunction with the accompanying drawings.

BRIEF DESCRIPTION OF THE DRAWINGS

FIG. 5 is an exploded perspective view of the surface-mount type antenna device shown in FIG. 4;

FIG. 6 is a diagram showing a circuit equivalent to the surface-mount type antenna device shown in FIG. 4;

FIG. 11 is an exploded perspective view of the surface-mount type antenna device shown in FIG. 10;

FIG. 12 is a diagram showing a circuit equivalent to the surface-mount type antenna device shown in FIG. 10;

DESCRIPTION OF PREFERRED EMBODIMENTS

Preferred embodiments of the present invention will be described with reference to the accompanying drawings.

Figure 1:
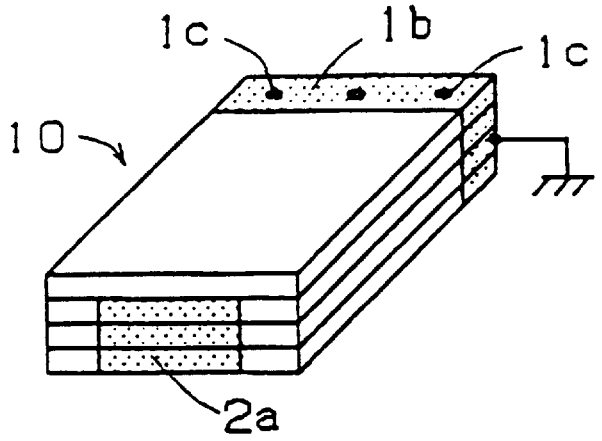
FIG. 1 is a perspective view of an embodiment of the surface-mount type antenna device of the present invention.

Referring to FIG. 1, a surface-mount type antenna device 10 in accordance with the present invention has a plurality of dielectric sheets made of a material such as ceramics laminated one on another. The laminated structure has a circuit pattern formed therein.

Figure 2:
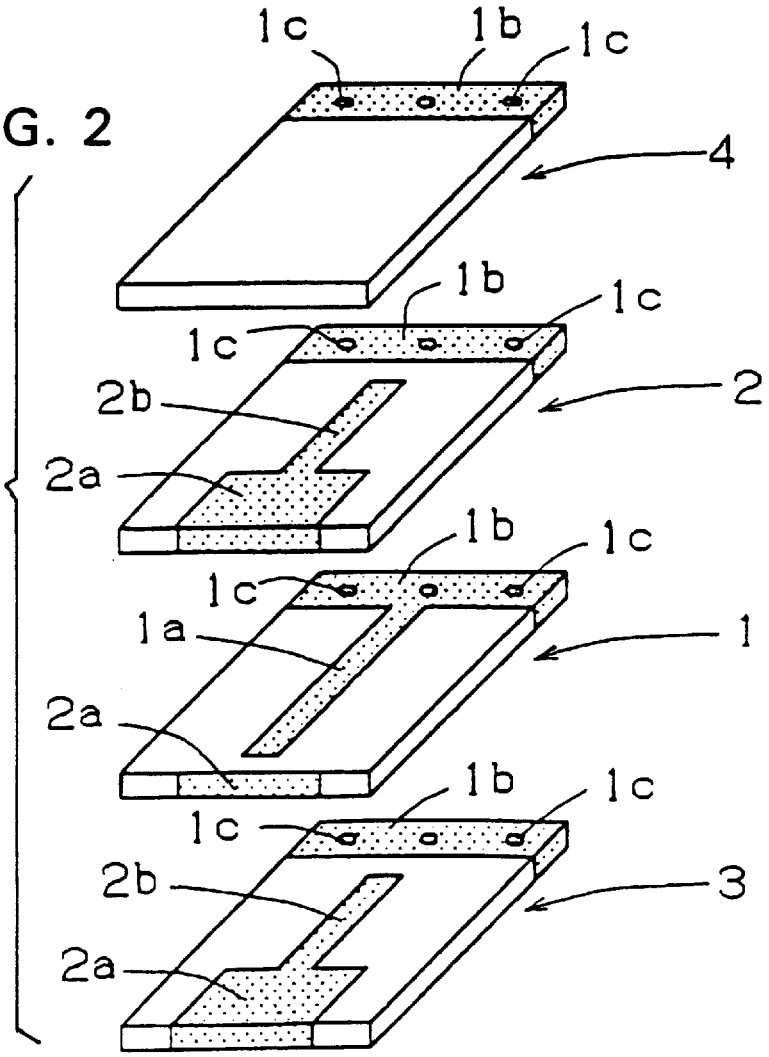
FIG. 2 is an exploded perspective view of the surface-mount type antenna device shown in FIG. 1.

More specifically, referring now to FIG. 2, a radiating electrode strip 1*a* is formed on the upper side of a first dielectric sheet 1 substantially at the center of this sheet 1. Although the radiating electrode 1*a* in this embodiment has a strip-like shape, this shape is not exclusive and various other configurations such as bar-shape, block-shape and so on may be employed. A portion of a ground electrode 1*b* is provided on one end of the dielectric sheet 1. Three through-holes 1*c* are formed to extend through this portion of the ground electrode 1*b* and the dielectric sheet 1. The radiating electrode strip 1*a* is connected at its one end to the portion of the ground electrode 1*b*, while the other end is extended to an area near the end face of the first dielectric sheet opposite to the ground electrode 1*b*, thus forming an open end.

An electrode which forms part of a feeder electrode 2*a* is provided on the proximal end of the dielectric sheet 1 as viewed in FIG. 2. No electrode is formed on the reverse side of the first dielectric sheet 1.

A portion of the ground electrode 1*b* is formed on one end of a second dielectric sheet 2. Through-holes 1*c* are formed to extend through this portion of the ground electrode 1*b* and the dielectric sheet 2. A portion of the feeder electrode 2*a* is formed on the end of the second dielectric sheet 2 opposite to the ground electrode 1*b*. A coupler electrode strip 2*b* extends substantially from the center of this portion of the feeder electrode 2*a* to an area near the portion of the ground electrode 1*b*. The second dielectric sheet 2 also is devoid of any electrode at the reverse side thereof.

A third dielectric sheet 3 has a construction which is substantially the same as that of the second dielectric sheet 2.

A fourth dielectric sheet 4 is provided at its one end with a portion of the ground electrode 1*b* and through-holes 1*c*. The fourth dielectric sheet 4 serves to protect the radiating electrode strip 1*a* and the coupler electrode strip 2*b*.

The surface-mount type antenna device 10 is fabricated by a process having the steps of: preparing four ceramics green sheets, printing electrode strips on the sheets as illustrated in FIG. 2, forming the through-holes in the respective sheets, laminating these sheets and then firing the laminated structure. The portions of the ground electrode 1*b* formed on the respective dielectric sheets are mutually coupled via the through-holes 1*c*, thus forming the ground electrode 1*b*. The portions of the feeder electrode 2*a* formed on the end surfaces of the first, second and third sheets are made to electrically contact with one another when these sheets are laminated, thus completing the feeder electrode 2*a*.

Figure 3:
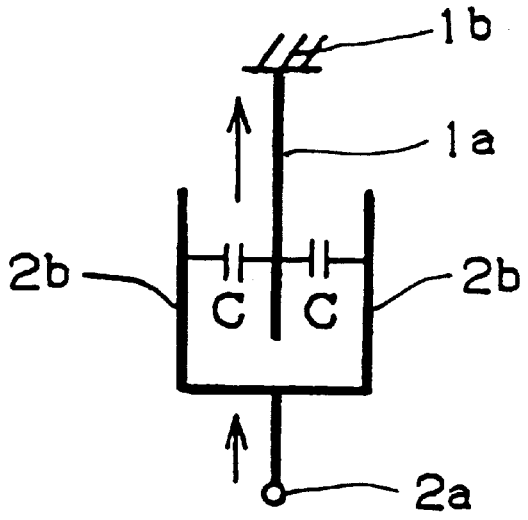
FIG. 3 is a diagram showing a circuit equivalent to the surface-mount type antenna device shown in FIG. 1.

FIG. 3 is a diagram showing an electrical circuit equivalent to the surface-mount type antenna device 10 described above. The radiating electrode strip la is sandwiched between a pair of coupler electrode strips 2*b* across the dielectric material. That is, the feeder electrode is electromagnetically coupled to the radiating electrode through capacitances C.

Thus, according to the invention, the first dielectric sheet having the radiating electrode 1*a* printed thereon and the second and third dielectric sheets 2 and 3 each having portions of the feeder electrode 2*a* and coupler electrode 2*b* are laminated such that the first sheet is sandwiched between the second and the third sheets, and these sheets are pressed and fired so that an antenna device is obtained in which a radiating electrode 1*a* and coupler electrodes 2*b* are formed in the dielectric structure and are electromagnetically coupled to each other through capacitances. An electrical current flows from the feeder electrode 2*a* to the ground electrode 1*b* as indicated by the arrow, whereby an electromagnetic field is radiated from the radiating electrode 1*a*.

Although in the described embodiment a pair of coupler electrodes 2*b* are used, this is not exclusive and the antenna device of the invention can be constructed so as to have only one coupler electrode 2*b* in the dielectric member. It is also possible to construct the antenna device in such a manner that the coupler electrodes 2*b* and the radiating electrode 1*a* are formed on the upper surface of a common dielectric sheet.

Figure 4:
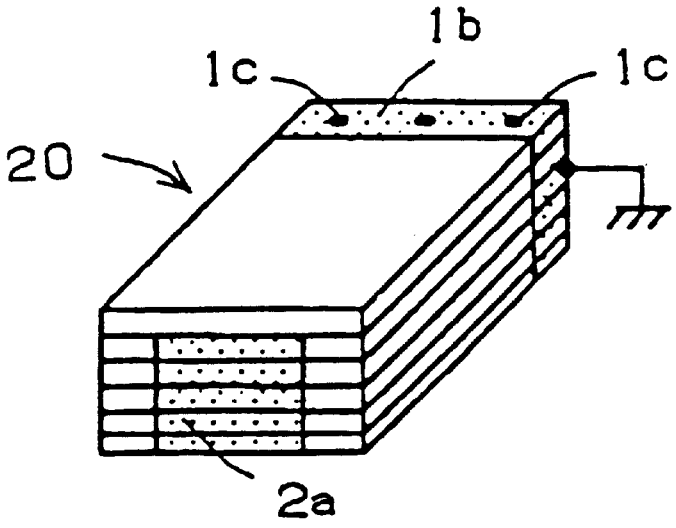
FIG. 4 is a perspective view of a second embodiment of the surface-mount type antenna device of the present invention.

A second embodiment of the present invention will be described with specific reference to FIGS. 4 to 6. As will be seen from FIG. 4, a second embodiment of the surface-mount type antenna device of the present invention, generally denoted by 20, has a basic structure which is substantially the same as the structure of the surface-mount type antenna device 10 shown in FIG. 10, and a fifth dielectric sheet and a sixth dielectric sheets added thereto. The fifth dielectric sheet and the sixth dielectric sheet have constructions which are the same as those of the first and third dielectric sheets of the surface-mount type antenna device 10 shown in FIG. 1.

This antenna device 20 can be fabricated by a process which is substantially the same as that for the antenna device 10 of the first embodiment. Namely, the antenna device 20 is produced by a process which has the steps of preparing six green sheets, printing electrode strips on the green sheets in accordance with the patterns illustrated in FIG. 5, forming through-holes in the green sheets, laminating the green sheets and firing the laminated structure.

The portions of the ground electrode 1*b* are connected mutually via the through-holes 1*c* so as to complete the ground electrode 1*b*. The portions of the feeder electrode 2*a* on the dielectric sheets, except for the fourth dielectric sheet, are mutually contacted at the end surfaces of these sheets when these sheets are laminated.

FIG. 6 is a diagram showing a circuit equivalent to the surface-mount type antenna 20. Each radiating electrode 1*a* is positioned between the adjacent feeder electrodes 2*b* so that each radiating electrode 1*a* is electromagnetically coupled to the adjacent feeder electrodes 2*b* through capacitances C. Consequently, the radiating electrodes 1*a*, 1*a* are supplied with power from the feeder electrode 2*a* in parallel with each other.

These radiating electrodes 1*a*, 1*a* may have different lengths. When radiating electrodes have different lengths, it is possible to obtain an antenna device which oscillates at two different resonance frequencies. Furthermore, since the radiating electrodes 1*a* extend in parallel with each other, the conductor loss of the antenna device is reduced to improve radiation efficiency.

A description will now be given of a third embodiment of the present invention with specific reference to FIGS. 7 to 9. A surface-mount type antenna device 30 of the third embodiment has, as in the preceding embodiments, a laminated structure of a plurality of dielectric sheets and a circuit pattern formed in the laminated structure.

Figure 8:
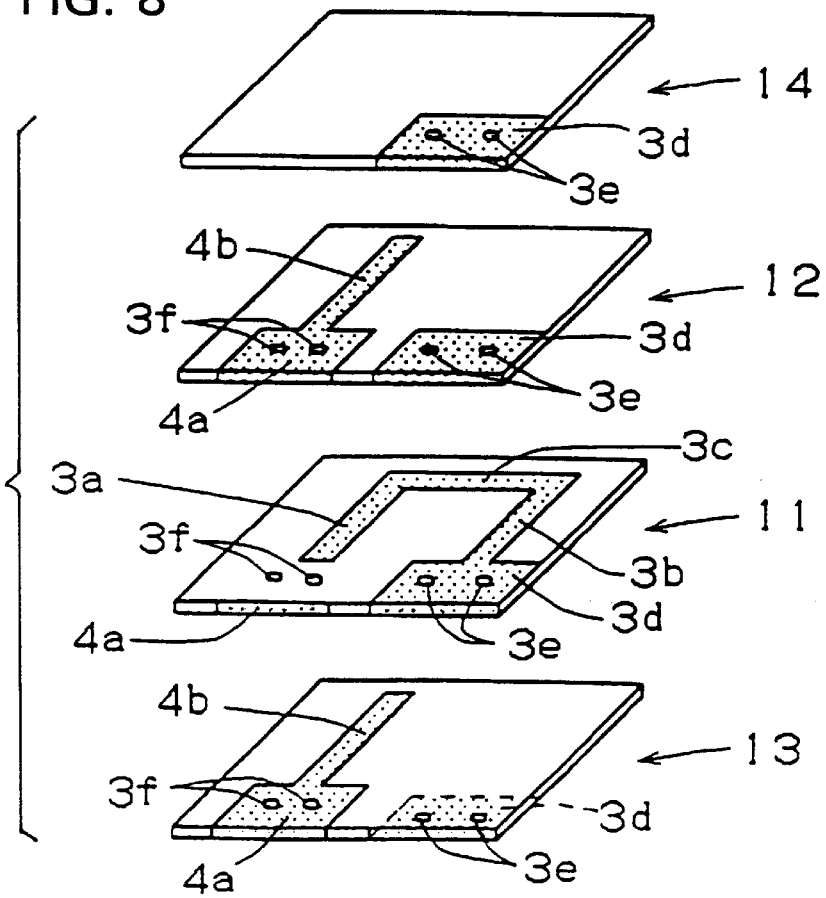
FIG. 8 is an exploded perspective view of the surface-mount type antenna device shown in FIG. 7.

Referring to FIG. 8, a plurality of parallel radiating electrode strips 3*a*, 3*b* are formed on the upper surface of a dielectric sheet 11. One end of the radiating electrode 3*a* is connected to one end of the radiating electrode 3*b* through a conductor pattern 3*c*, whereby a substantially U-shaped strip is formed. The other end of the radiating electrode 3*a* is opened, while the other end of the radiating electrode 3*b* is connected to a portion of a ground electrode 3*d*. This portion of the ground electrode 3*d* is extended to appear on the proximal end surface of the dielectric sheet 11. Through-holes 3*e* are formed to extend through the dielectric sheet 11 in the area of this portion of the ground electrode 3*d*, while a pair of through-holes 3*f* are formed in an area adjacent to the open end of the radiating electrode 3*a*.

A portion of a feeder electrode 4*a* is formed on the proximal end surface of the dielectric sheet 11 at a region which is at the extension of the open end of the radiating electrode 3*a*.

A second dielectric sheet 12 has a coupler electrode 4*b* formed thereon, such that, when the second dielectric sheet 12 is superposed on the first dielectric sheet 11, the coupler electrode 4*b* is disposed above the radiating electrode 3*a*. The coupler electrode 4*b* is opened at its one end and connected at its other end to a portion of the feeder electrode 4*a* which is provided on the proximal end surface of the dielectric sheet 12. Through-holes 3*f* are formed to extend though the sheet 12 in the area of the feeder electrode 4*a* so as to be aligned with the through-holes 3*f* formed in the first dielectric sheet 11. The second dielectric sheet 12 also has a portion of the ground electrode 3*d* at a position corresponding to the portion of the ground electrode 3*d* on the first sheet 11. Similarly, through-holes 3*e* are formed in this second dielectric sheet 12 in alignment with the through-holes 3*e* in the first dielectric sheet 11.

A third dielectric sheet 13 has almost the same pattern of electrodes as those of the second dielectric sheet 12, except that a portion of the ground electrode 3*d* is formed on the underside of the sheet 13.

A fourth dielectric sheet 14 has a portion of the ground electrode 3*d* and through holes 3*e* which are to be respectively aligned with the portion of the ground electrode 3*d* and the through holes 3*e* of the second dielectric sheet 12 when the fourth sheet 14 is superposed thereon.

As in the preceding embodiments, the surface-mount type antenna device 30 of the third embodiment is fabricated by forming strip patterns and through-holes in the green sheets in accordance with the configurations shown in FIG. 8, laminating these sheets and firing the laminated structure. Portions of the electrode 4*a* and the portions of the electrode 3*d* which appear on the end surfaces of the green sheets are integrated together on the end surface of the laminated structure 30 and are connected together also internally of the laminated structure 30 through the surfaces defining the through-holes 3*f*, 3*e*.

Figure 9:
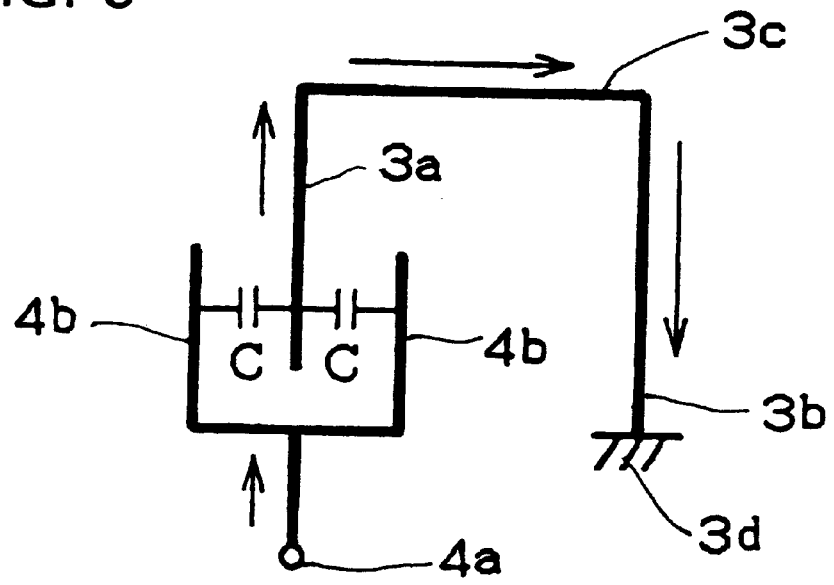
FIG. 9 is a diagram showing a circuit equivalent to the surface-mount type antenna device shown in FIG. 7.

FIG. 9 is a circuit diagram of a circuit equivalent to the surface-mount type antenna device 30. The radiating electrode 3*a* is sandwiched between coupler electrodes 4*b* and is electro-magnetically coupled thereto through capacitances C formed therebetween. In operation, electric current flows through the radiating electrode 3*a* in the direction of the arrow to the ground electrode 3*d* via the conductor pattern 3*c* and the radiating electrode 3*b*, whereby an electromagnetic wave is radiated from the radiating electrode 3*a*, conductor pattern 3*c* and the radiating electrode 3*b*.

The relative magnitude between the electric current in the radiating electrode 3*a* and the electric current in the radiating electrode 3*b* depends on the magnitude of the coupling capacitance C between the radiating electrode 3*a* and the coupler electrodes 4*b*. In other words, the surface-mount type antenna device 30 can be so constructed that the amplitude of the current flowing through the radiating electrode 3*a* is smaller than that of the current flowing through the radiating electrode 3*b*. Therefore, even when the electric current in the radiating electrode 3*a* flows in the direction counter to the direction of the radiating electrode 3*b*, such a counter-flow of the current does not cause any significant attenuation of the electromagnetic field, because the radiation of the electromagnetic field is chiefly effected by the radiating electrode 3*b* in which the electrical current of the greater magnitude flows.

The surface-mount type antenna device 30 exhibits a pattern of radiation of electromagnetic wave approximating a nondirectional pattern, because the radiating electrodes 3*a*, 3*b* and the bridging conductor pattern 3*c* in cooperation form an electromotive-type radiator. In addition, since the radiating electrodes 3*a*, 3*b* form a U-shape, the size of the antenna device can be reduced, while the frequency band is widened, without requiring an increase in the specific dielectric constant of the dielectric member.

In the surface-mount type antenna device 30 of this embodiment, the radiating electrode 3*a*, which is chiefly intended for coupling to the coupler electrodes 4*b*, and the radiating electrode 3*b*, which is intended chiefly for electromagnetic field radiation/excitation, can be designed independently of each other, thus affording a wider degree of design freedom in regard to the factors such as resonance frequency and radiation resistance.

Figure 10:
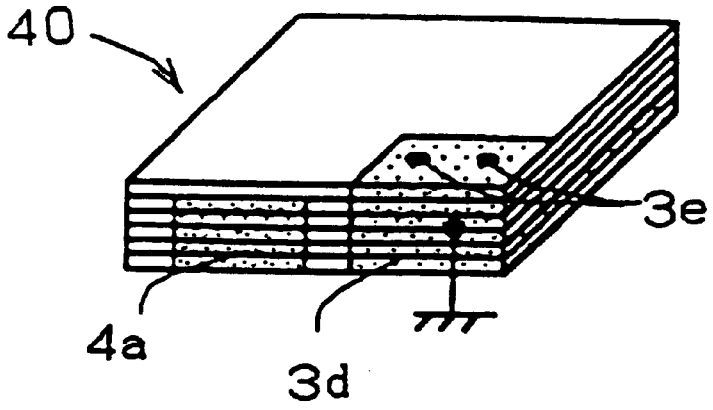
FIG. 10 is a perspective view of a fourth embodiment of the surface-mount type antenna device of the present invention.

A description will now be given of a fourth embodiment of the present invention with specific reference to FIGS. 10 to 12.

Figure 7:
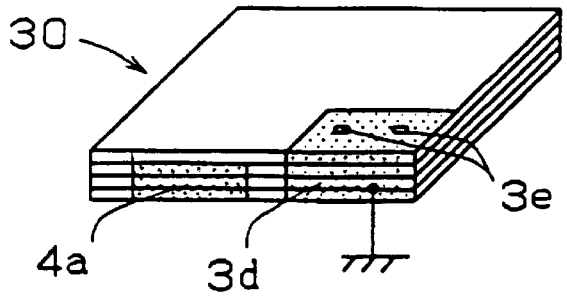
FIG. 7 is a perspective view of a third embodiment of the surface-mount type antenna device of the present invention.

The surface-mount type antenna device 40 in accordance with the fourth embodiment of the present invention is constructed by interposing a pair of dielectric sheets 13*a* and 15 between the dielectric sheets 11 and 13 of the surface-mount type antenna device 30 shown in FIG. 7. The constructions of the dielectric sheets 13*a* and 15 are materially the same as those of the dielectric sheets 12 and 11 described before. Thus, the surface-mount type antenna device 40 can be produced through a process which is substantially the same as those for the production of the surface-mount type antenna devices 10, 20 and 30 of the preceding embodiments. Thus, the surface-mount type antenna device 40 is produced by laminating six green sheets having electrode strips printed thereon, and firing the laminated structure.

The portions of the ground electrode 3*d* on the respective dielectric sheets are mutually connected through the end surfaces of these sheets and via the through-holes 3*e*, thus completing the ground electrode 3*d*. The portions of the feeder electrode 4*a* formed on the respective dielectric sheets except for the fourth dielectric sheet 14 are also mutually connected through the end surfaces of these sheets and via the through-holes 3*f*, thus completing the feeder electrode 4*a*.

FIG. 12 is a diagram showing a circuit equivalent to the surface-mount type antenna device 40. Each of a pair of radiating electrodes 3*a* are placed between two adjacent coupler electrodes 4*b* across capacitances C formed therebetween, so as to be electromagnetically coupled to these coupler electrodes 4*b* through the capacitances C. The pair of radiating electrodes 3*a* are supplied with power from the feeder electrode 4*a* in parallel with each other.

In the embodiments described hereinbefore, the coupler electrodes and the radiating electrodes are formed on different dielectric sheets which are laminated one on another to realize a three-dimensional arrangement of the electrodes such that the coupler electrodes and the radiating electrodes are electromagnetically coupled through capacitances formed therebetween. This three-dimensional arrangement, however, is not exclusive and the coupler electrodes and the radiating electrodes may be formed in an inter-digitating manner on the same dielectric sheet so as to realize a planar arrangement of the electrodes so that the radiating electrodes are electro-magnetically coupled to the coupler electrodes through capacitances provided by the dielectric sheet.

Figure 13:
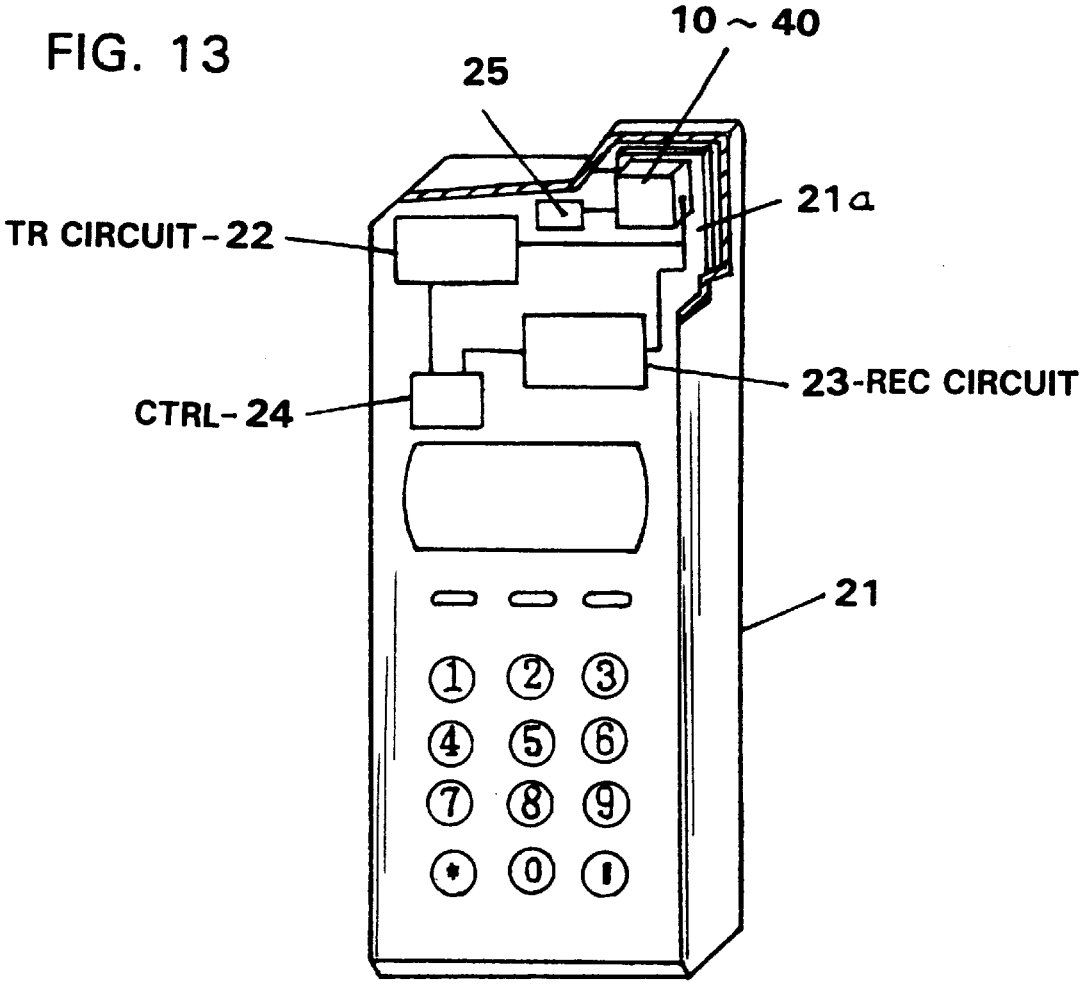
FIG. 13 is a partly cut-away perspective view of a communication apparatus containing the surface-mount type antenna device of an embodiment of the present invention.
Figure 14:
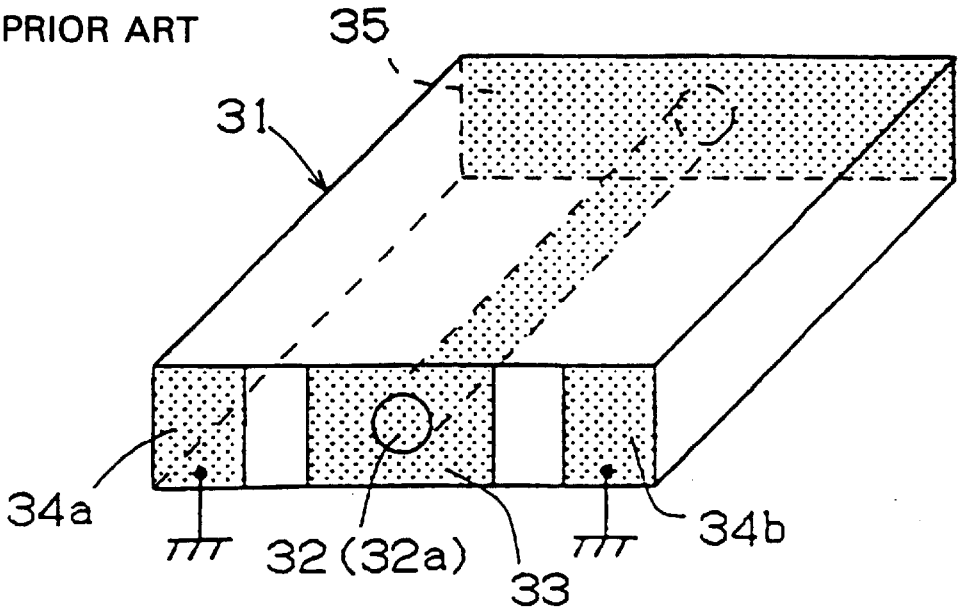
FIG. 14 PRIOR ART
FIG. 14 is a perspective view of a conventional surface-mount type antenna device.

Each of the surface-mount type antenna devices 10, 20, 30 and 40 can be mounted on a printed circuit board 21*a* of a communication apparatus 21, with the ground electrode and the feeder electrode soldered to mating portions of the printed circuit board 21*a* as indicated in FIG. 13. The communication apparatus comprises a transmitter circuit 22, a receiver circuit 23, a transmission/receiving control unit 24 and a power supply 25. The power supply 25 is connected to the feeder electrode of the antenna device, while the transmitter circuit 22 and the receiver circuit 23 are connected to the radiating electrode of the antenna device. The transmission/receiving control unit performs control of the signal to be transmitted through the antenna device or the signal received through the antenna device.

As will be understood from the foregoing description, the present invention offers the following advantages.

The antenna device of the present invention has a laminated dielectric structure formed by lamination of a plurality of dielectric sheets followed by firing, the laminated dielectric structure having therein radiating electrodes and feeder electrodes which are coupled through capacitances. The radiation resistance and the resonance frequency can be controlled by adjusting the capacitances. It is possible to widen the frequency band, partly because the radiation resistance and the resonance frequency can be controlled by adjusting the capacitances and partly because the size of the antenna device can be reduced even with a dielectric material having a comparatively small dielectric constant. This means that the present invention makes it possible to lower the specific dielectric constant as compared with the conventional antenna device, if the resonance frequencies are equal.

When the antenna device of the present invention is constructed so as to have a plurality of radiating electrodes connected together, electric current flows in different directions through these radiating electrodes. It is thus possible to reduce the number of the null points in the pattern of directivity of the electric field.

According to the present invention, it is also possible to form a surface-mount type antenna device having a plurality of resonance frequencies, by forming a plurality of radiating electrodes on different dielectric sheets, thus enabling reduction in the conductor loss and a consequent improvement in efficiency.

The communication apparatus of the invention containing the surface-mount type antenna device of the invention permits the RF circuit portion of the apparatus to be connected to the antenna via a minimum path length, while eliminating necessity for any coupling element. It is therefore possible to minimize any offset of frequency due to mismatching which otherwise may exist due to the wiring pattern, while diminishing the overall length of the communication apparatus.

Although the invention has been described through its preferred forms, it is to be understood that the described embodiments are only illustrative and various changes and modifications may be imparted thereto without departing from the scope of the invention.

What is claimed is:

1. A communication apparatus, comprising:

a transmitting/receiving control unit;

a transmitting circuit connected to said transmitting/receiving control unit;

a receiving circuit connected to said transmitting/receiving control unit;

a power supply unit; and an antenna device;

wherein said antenna device comprises:

a ceramic dielectric block;

radiating electrode strips disposed inside said dielectric block; and coupler electrode strips disposed inside said dielectric block so as to be electromagnetically coupled to said radiating electrode strips and connected to said power supply unit, said radiating electrode strips and said coupler electrode strips each comprising respective electrode strips disposed on respective surfaces of respective sheet layers, the sheet layers being laminated and fired together to form the ceramic dielectric block so that the electrodes are embedded in the block, said radiating electrode strips and said coupler electrode strips being laminated alternately such that at least one of said radiating electrode strips is interposed between said coupler electrode strips, and further wherein:

at least one of said radiating electrode strips is connected to a radiating electrode which is extended to the exterior of said dielectric block so as to be accessible from the exterior; and wherein at least one of said radiating electrode strips includes:

a first portion disposed in the vicinity of said coupler electrode strips so as to be electromagnetically coupled with said coupler electrode strips; and a second portion disposed in the vicinity of an outer surface of said dielectric block away from and not opposed to the coupler electrode and forming a substantially smaller electromagnetic coupling with said coupler electrode strips than said first portion.

2. An antenna device, comprising:

a ceramic dielectric block;

radiating electrode strips disposed inside said dielectric block; and coupler electrode strips disposed inside said dielectric block so as to be electromagnetically coupled to said radiating electrode strips; said radiating electrode strips and said coupler electrode strips each comprising respective electrode strips disposed on respective surfaces of respective sheet layers, the sheet layers being laminated and fired together to form the ceramic dielectric block so that the electrodes are embedded in the block;

said radiating electrode strips and said coupler electrode strips being laminated alternately such that at least one of said radiating electrode strips is interposed between said coupler electrode strips, and further wherein:

at least one of said radiating electrode strips is connected to a radiating electrode which is extended to the exterior of said dielectric block so as to be accessible from the exterior; and wherein at least one of said radiating electrode strips includes:

a first portion disposed in the vicinity of said coupler electrode strips so as to be electromagnetically coupled with said coupler electrode strips; and a second portion disposed in the vicinity of an outer surface of said dielectric block away from and not opposed to the coupler electrode and forming a substantially smaller electromagnetic coupling with said coupler electrode strips than said first portion.

3. An antenna device according to claim 2, wherein said radiating electrode strips include at least a pair of radiating electrode strips having different areas.

4. An antenna device according to claim 2, wherein said coupler electrode strips are connected to a coupler electrode which is extended to the exterior of said dielectric block so as to be accessible from the exterior.

5. An antenna device according to claim 2, wherein said first and second portions are connected to each other through a bridging strip.

6. An antenna device according to claim 5, wherein said first portion, said second portion and said bridging strip form a U-shaped conductor strip.

7. A method of producing an antenna device, comprising the steps of:

preparing a first dielectric ceramic green sheet;

forming a radiating electrode pattern on said first dielectric ceramic green sheet by applying a radiating electrode forming material thereon;

preparing a second dielectric ceramic green sheet;

forming a coupler electrode pattern on said second dielectric ceramic green sheet by applying a coupler electrode forming material at a position where said coupler electrode pattern forms an electromagnetic coupling with said radiating electrode pattern when said first dielectric ceramic green sheet is superposed on said second dielectric ceramic green sheet;

forming a laminated structure by alternately laminating at least one said first dielectric ceramic green sheet and at least one said second dielectric ceramic green sheet;

applying, to an outer surface of said laminated structure, a first external electrode material in electrical connection to said radiating electrode;

applying, to an outer surface of said laminated structure, a second external electrode material in electrical connection to said coupler electrode;

further comprising the step of providing the radiating electrode pattern as a radiating electrode strip connected to the first external electrode material and providing the coupler electrode pattern as a coupler electrode strip; and wherein said step of providing said radiating electrode pattern as a radiating electrode strip includes:

providing a first radiating electrode pattern portion disposed in the vicinity of said coupler electrode strip so as to be electromagnetically coupled with said coupler electrode strip; and providing a second radiating electrode pattern portion disposed in the vicinity of an outer surface of said laminated structure away from and not opposed to the coupler electrode strip and having a substantially smaller electromagnetic coupling with said coupler electrode strip than said first portion; and firing said laminated structure.

8. A communication apparatus comprising:

a transmitting/receiving circuit; and an antenna device coupled to the transmitting/receiving circuit comprising a ceramic dielectric block;

a radiating electrode disposed inside said dielectric block; and a coupler electrode disposed inside said dielectric block electromagnetically coupled to said radiating electrode, said radiating electrode comprising a plurality of radiating electrode strips and said coupler electrode comprising a plurality of coupler electrode strips, the radiating electrode strips and coupler electrode strips disposed on respective surfaces of a respective sheet layers, the sheet layers being laminated and fired together to form the ceramic dielectric block so that the electrodes are embedded in the block, said radiating electrode strips and said coupler electrode strips being laminated alternately such that at least one of said radiating electrode strips is interposed between said coupler electrode strips, and further wherein:

at least one of said radiating electrode strips is connected to a radiating electrode connection which is extended to the exterior of said dielectric block so as to be accessible from the exterior; and wherein at least one of said radiating electrode strips includes:

a first portion disposed in the vicinity of said coupler electrode strips so as to be electromagnetically coupled with said coupler electrode strips; and a second portion disposed in the vicinity of an outer surface of said dielectric block and away from and not opposed to the coupler electrode and forming a substantially smaller electromagnetic coupling with said coupler electrode strips than said first portion.

* * * * *